United States Patent [19]

Brown

[11] Patent Number: 4,984,304

[45] Date of Patent: Jan. 15, 1991

[54] UNDERGARMENT

[76] Inventor: James G. Brown, P.O. Box 675, McGraw, N.Y. 13101

[21] Appl. No.: 278,955

[22] Filed: Dec. 2, 1988

[51] Int. Cl.[5] ..... A41B 9/00

[52] U.S. Cl. ..... 2/401; 2/400; 2/406

[58] Field of Search ..... 2/400, 401, 406, 407, 2/408; 450/99, 101, 112, 117, 138, 137, 140, 142, 143

[56] References Cited

U.S. PATENT DOCUMENTS

| | | | |
|---|---|---|---|
| 1,494,044 | 5/1924 | Ward et al. | 2/406 |
| 2,288,553 | 6/1942 | Slezak | 2/401 |
| 2,332,141 | 10/1943 | Greene | 450/99 |
| 2,641,257 | 6/1953 | Rutledge | 2/401 X |
| 2,792,698 | 5/1957 | Hampp | 2/401 X |
| 2,898,918 | 8/1959 | Roura et al. | 450/101 |
| 3,228,401 | 1/1966 | Byrne | 450/143 X |
| 3,283,759 | 11/1966 | Welsch et al. | 450/117 X |
| 3,312,981 | 4/1967 | McGuire et al. | 2/406 |
| 3,339,554 | 9/1967 | Nobbs | 450/99 X |
| 3,375,829 | 4/1968 | Brennan et al. | 450/115 |
| 3,489,154 | 1/1970 | Kaspar et al. | 450/97 |
| 3,909,847 | 10/1975 | Holt et al. | 2/401 X |
| 4,476,895 | 10/1984 | Shibusawa | 2/401 X |

FOREIGN PATENT DOCUMENTS

| | | | |
|---|---|---|---|
| 0064826 | 12/1955 | France | 450/99 |

*Primary Examiner*—Werner H. Schroeder
*Assistant Examiner*—Jeanette E. Chapman
*Attorney, Agent, or Firm*—Philip Furgang

[57] ABSTRACT

An undergarment is fabricated with a body portion of a size and configuration to cover the lower torso of a person and with an upper body encircling opening and lower leg encircling openings. The garment is further sized to extend from proximate a person's waist to proximate where a person's legs join their lower torso and so as to cover at least the lower buttock cheeks of a person. Inside panels extend down and within each side of the panty and then in an arc across the area thereof to be disposed proximate a person's lower buttock cheeks. A relatively thin piece of foam rubber is sewn between the inside panel and the body portion fabric in the area thereof to be disposed proximate a persons buttock cheeks to shape and uplift the buttock cheeks. In an alternate embodiment the inside panel only extends across the area of the lower buttock cheeks.

14 Claims, 2 Drawing Sheets

UNDERGARMENT

BACKGROUND OF THE INVENTION-FIELD OF APPLICATION

This invention relates to undergarments; and more particularly, to panty, long leg, briefs or briefer undergarments.

BACKGROUND OF THE INVENTION-DESCRIPTION OF THE PRIOR ART

Panty, long leg, brief or briefer type undergarments are generally of a configuration to cover the lower torso of a person; child, man and woman. These undergarments are usually made with body encircling portions which include front and rear panels that may be formed as one unitary piece, as separate panels sewn or otherwise attached together, as multiple front and rear panels suitably secured together or in a myriad of ways. A crotch panel is secured to the body encircling portion, and elastic is often secured to the body fabric about the upper body encircling portion thereof and around leg openings to facilitate the fit of the undergarment to the wearer.

Many panty or brief-type undergarments, such as those of the type shown in U.S. Pat. No. 2,250,218 granted on July 22, 1941 to E. Cadous for Pantie include special inset panels of stretchable material to facilitate conforming the panty to the wearers figure. Other panty or brief-type undergarments, such as those of the type shown in U.S. Pat. No. 2,344,374 granted on Mar. 14, 1944 to Z.A. Stephens for Lady's Undergarment, and in U.S. Pat. No. 2,344,375 granted on Mar. 14, 1944 to Z.A. Stephens for Lady's Undergarment, even include special inset panels of both one-way and two-way stretchable material to facilitate stooping and sitting of the wearer of the garment. Panty or brief-type undergarments, such as those shown in U.S. Pat. No. 2,288,553 granted on June 30, 1942 to F.J. Slezak for Undergarment, that include stretch type panels are even constructed and configured for men and boys. However, such undergarment constructions do not otherwise facilitate desired flattering of particular portions of the wearers figure such as in the buttock area.

Special panty or brief-type undergarment constructions, such as those of the type shown in U.S. Pat. No. 4,355,425 granted on Oct. 26, 1982 to B.N. Jones, et al for Panty With A Built-In Elastic System To Minimize Gathering And Provide A Comfortable Fit And Method To Assemble A Panty, and in U.S. Pat. No. 4,462,115 granted on July 31, 1984 to L.A. Carlson et al for Woman's Protective Undergarment For Volleyball, are also available. However, here again, such panty and brief-type constructions are for the special purposes evident from the titles of the patents and do not serve to flatter a particular body feature such as in the buttock area.

Still other panty or brief-type undergarment constructions or configurations, of the type shown in U.S. Pat. No. 4,701,964 granted on Oct. 27, 1987 to W.D. Bell et al for Garment Having Additional Support To Selected Portions are available. But such constructions involve special thermoplastic adhesives and the relatively expensive equipment and processes that are attendant to and required by the use thereof and can add undesirably to the cost of the resulting undergarment.

SUMMARY OF THE INVENTION

It is therefore an object of this invention to provide a new and improved undergarment.

It is another object of this invention to provide a new and improved panty, long leg, brief, or briefer undergarment.

It is a further object of this invention to provide a new and improved undergarment that facilitates disposition of a portion of the wearers body into a particular configuration.

It is yet another object of this invention to provide a new and improved undergarment that provides a shaping and uplift for the buttocks of the wearer.

It is yet still another object of this invention to provide a new and improved undergarment that provides a shaping and uplift for the lower portion of the buttocks of the wearer to thus provide a flattering appearance for that area of the wearer's anatomy.

This invention involves providing a support panel in a particular area of an undergarment in such a way and of such a construction that when the undergarment is worn a shaping and uplift of the lower buttocks and a flattering of the figure results.

Other object, features and advantages of the invention in its details of construction and arrangement of parts will be seen from the above and from the following description of the preferred embodiments when considered with the drawing and from the appended claims.

DESCRIPTION OF THE PREFERRED EMBODIMENT

For convenience, the invention will be described for use in a number of undergarments including a panty, long leg, brief or briefer. This undergarment may be fabricated from a single unitary piece of undergarment body material either with a back seam or unseamed, with a separate crotch portion, and with bands of elastic type material about the upper opening and about the leg openings. It should be understood, nevertheless, that without departing from the invention, that the crotch portion may be integrally or otherwise formed, that the body portion may be formed of front and rear panels with side seams or of any other desired number of panels suitable and appropriately secured together to form the panty, long leg, brief, or briefer undergarment and that the upper and leg openings may be formed without utilizing bands of elastic or with bands of other suitable and appropriate material or materials.

Figure 1:
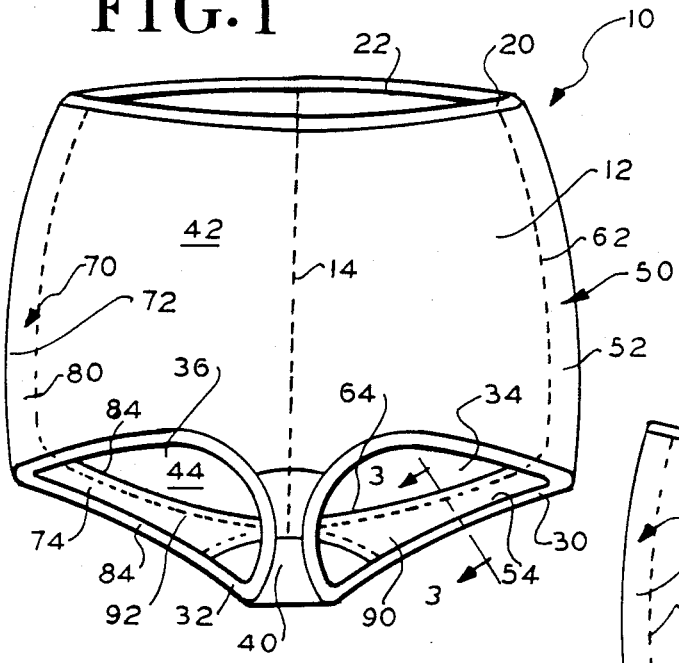
FIG. 1 is a perspective view of a panty or brief-type undergarment incorporating the instant invention.
Figure 3:
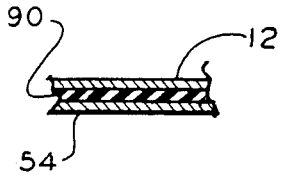
FIG. 3 is a partial sectional view of the undergarment of FIGS. 1 and 2 taken on line 3—3 of FIG. 1.
Figure 4:
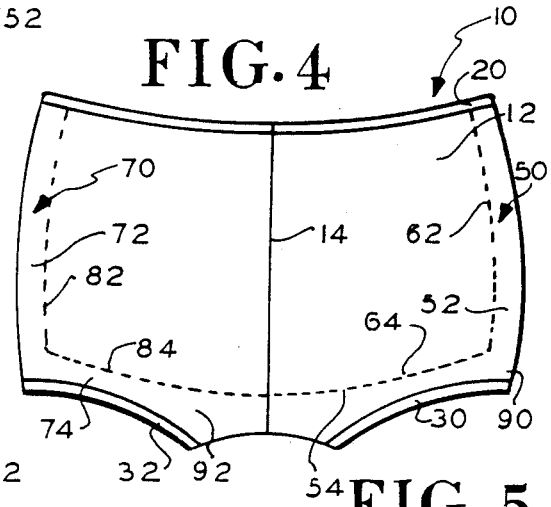
FIG. 4 is a rear elevational view of the undergarment of FIGS. 1–3.
Figure 2:
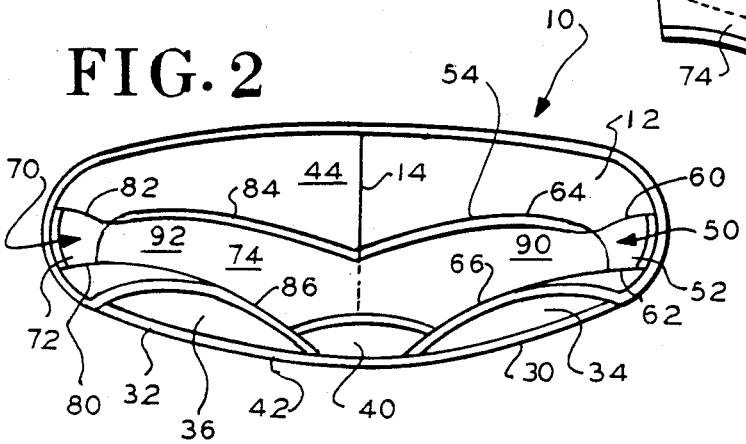
FIG. 2 is a plan view of the panty or brief-type undergarment of FIG. 1 looking therewithin to show details of the construction thereof.

With reference to FIGS. 1, 2, and 4 there is generally shown at 10 an undergarment of the panty or brief-type and of a size and configuration to be worn by a female. This is by way of example. The invention disclosed herein is also applicable to long leg and briefer undergarments. Panty 10 includes a body portion 12, fabricated from suitable body material such as cotton, nylon, spandex, or the like, or any combination thereof, and which is formed from a single and unitary piece of such body material into the configuration and desired size or sizes. A seam 14 extends down the back of the panty to hold the ends of body portion 12 together to form panty 10. Seam 14 is formed by sewing or other suitable and conventional process.

A band of elastic-type material 20 (FIGS. 1 and 2) encircles a top opening 22 of panty 10 and is secured thereabout in a conventional manner as by sewing. Leg bands 30, 32, also of elastic-type material, encircle leg openings 34, 36, and are secured thereabout in a conventional manner as by sewing or the like. A crotch panel 40 connects a front wall 42 to a rear wall 44 thereof and forms a separation between leg openings 34, 36.

The materials from which body portion 12, crotch portion 40 and bands 20, 30 and 32 are formed may be any conventional and suitable material utilized to fabricate undergarments. The particular number of panels utilized to construct and configure the undergarment and the manner of attachment thereof may be selected as desired.

Figure 5:
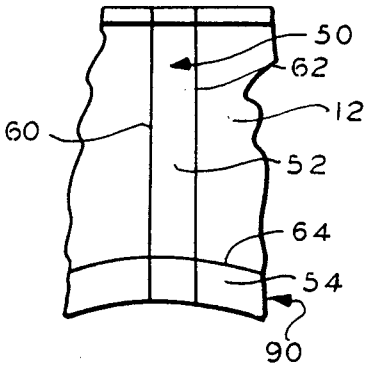
FIG. 5 is an inside elevational view of a portion of the undergarment of FIGS. 1–4.

A first inside panel 50, FIGS. 1–4, is preferably formed of the same material as utilized for body portion 12 and is of a predetermined width, preferably between 1 inch and 2 inches It includes a side portion 52 and a lower portion 54 that are secured in place, as by sewing or other conventional method, along seam lines 60, 62, 64 (FIG. 5). A further seam line 66 also corresponds to a portion of the seam line utilized to secure leg band 30 in place. Panel 50 is secured within panty 10 proximate where a side seam would be.

A second inside panel 70 is formed substantially identical to that of panel 50 but is disposed within panty 10 diametrically opposite to the inside disposition of panel 50. Panel 70 includes a side portion 72 and a lower portion 74 that are secured in place, like portions 52 and 54 of panel 50 along seam lines 80, 82, 84 and 86.

A piece of relatively thin foam rubber 90 (FIG. 3) preferably one-sixteenth of an inch thick, but which could be slightly thicker or thinner, is disposed between lower portion 54 of panel 50 and the material of body portion 12. A similar piece of foam rubber 92 is disposed between lower portion 74 of second panel 70 and the material of body portion 12. Pieces 90, 92 of foam rubber are sized to fit within the spaces provided between lower portions 54, 74 of panels 50, 70 and the adjacent fabric of body portion 12 and within the confines of the seam lines 64–66 and 84–86. Foam pieces 90, 92 may also be sized to be sewn in place by the respective seam lines 64–66, 84–86. Foam pieces 90, 92 may also be formed as a single piece disposed in the spaces formed between lower portions 54, 74 and their respective body fabric and seam lines.

Foam pieces 90, 92, their size, configuration and disposition as described above serve to shape and lift the buttocks of a person wearing panty 10. The function of inside panels 50, 70 and of foam pieces 90, 92 is enhanced by forming panels 50, 70 to narrow as they cross the area of panty 10 that is to be disposed proximate the buttocks cheeks. The narrowing helps in the lifting of the buttocks cheeks. If desired foam pieces 90, 92 may be eliminated but the inclusion of inside panels 50, 70 will still provide a selected degree of shaping and uplifting for the buttocks.

Figure 6:
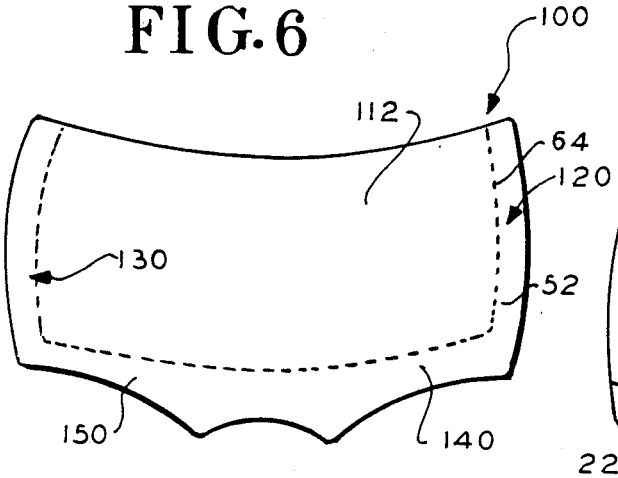
FIG. 6 is a schematic rear elevational view of another embodiment of panty or brief-type undergarment incorporating the instant invention.

In FIG. 6 there is shown an alternative embodiment of undergarment 100 including a body portion 112 formed, in conventional manner, but without a rear seam like panty 10 of the embodiment of FIGS. 1–5. Panty 100 includes inside panels 120, 130 formed, disposed and attached within panty 100 like panels 50 and 70 are formed, disposed and attached within panty 10. Foam pieces 140, 150 are disposed between the fabric of panels 120, 130 and that of panty body portion 112 in the same manner and disposition that foam pieces 90, 92 are disposed in panty 10 of FIGS. 1–5. Foam pieces 140, 150 are formed of the same material, thickness and size as foam pieces 90, 92.

Figure 7:
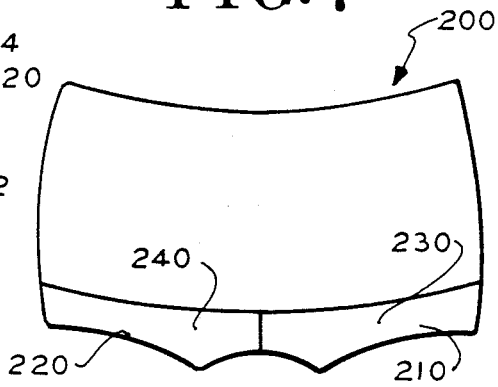
FIG. 7 is a schematic rear elevational view of yet another embodiment of panty or brief-type undergarment incorporating the instant invention.

In the FIG. 7 embodiment there is shown an alternative embodiment of undergarment 200 also formed without a rear seam. Panty 200 includes inside panels 210, 220 which are formed, disposed, and secured within panty 200 corresponding to that of lower portions 54, 74 of panels 50, 70 of the embodiment of FIGS. 1–5. Foam pieces 230, 240 of a size, configuration and construction corresponding to foam pieces 90, 92 of the FIG. 1–5 embodiment, may be disposed between the material of panels 210, 220 and that of panty 200 in the manner that foam pieces 90, 92 are disposed.

In the embodiments of FIGS. 6 and 7 the respective constructions of panties 100, 200 will also serve to shape and lift the buttocks of the wearer.

From the above description it will thus be seen that there has been provided new and improved undergarments which through a relatively simple and inexpensive construction provide for a shaping and uplifting of the buttocks of the wearer.

It is understood that although I have shown the preferred forms of my invention that various modifications may be made in the details thereof without departing from the spirit as comprehended by the following claims.

What is claimed is:

1. An undergarment comprising:

(a) means for enclosing a human body of a size and configuration to encircle at least the lower torso of a person proximate where the person's legs meet their torso and so as to be disposed proximate and to cover at least the lower buttock cheeks of the person;

(b) said body means including an upper portion for disposition about a person's lower torso and lower openings to facilitate disposition thereof about a persons upper legs, said openings being defined by the leg bands; and (c) means for providing an inside panel secured within said body means proximate said portion thereof to be adjacent to said leg bands in a region which is disposed proximate to the lower buttock cheeks of a person;

(d) said inside panel means including an insert piece being of a size, configuration, and disposition to shape and uplift the buttock cheeks of a person wearing the undergarment.

2. The undergarment of claim 1, wherein said body means is of a size and configuration to extend from at least proximate a person's waist to wherein their legs engage their torso.

3. The undergarment of claim 2, wherein said inside panel means extends within and at least along one side of said body portion from proximate the waist of the person down to proximate said lower opening thereof and along and within said portion thereof to be disposed proximate the lower buttock cheeks of a person.

4. The undergarment of claim 3, wherein said inside panel means also extends up from said portion to be disposed proximate the lower buttock cheeks of a person along and inside said body portion at a side disposition thereof opposite said one side and up proximate to the waist of the person.

5. The undergarment of claim 4, wherein said piece means is disposed between said inside panel means and said body portion in said portion thereof to be disposed proximate the lower buttock cheeks of a person.

6. The undergarment of claim 5, wherein said piece means is in the form of a band which narrows across said portion to be disposed proximate the lower buttock cheeks of a person.

7. The undergarment of claim 6, including a crotch portion spanning said body portion proximate a mid-area thereof at said lower opening to form a pair of spaced leg openings.

8. The undergarment of claim 7, wherein said piece means is formed of foam rubber.

9. The undergarment of claim 8, wherein said foam rubber piece is relatively thin.

10. The undergarment of claim 9, wherein said foam rubber piece is one-sixteenth of an inch thick.

11. The undergarment of claim 7, including a rear seam connecting said body portion into a body encircling configuration.

12. The undergarment of claim 7, wherein elastic type bands surround said leg openings.

13. The undergarment of claim 11, wherein said elastic-type bands are sewn to said body portion so as to surround said leg openings.

14. The undergarment of claim 13, wherein said inside panel means and such elastic type band means are sewn together to said body means proximate said leg openings.

* * * * *